US010457083B2

(12) United States Patent
Peleman

(10) Patent No.: US 10,457,083 B2
(45) Date of Patent: Oct. 29, 2019

(54) BINDING FOLDER

(71) Applicant: UNIBIND LIMITED, Nicosia (CY)

(72) Inventor: Guido Frans M. Peleman, Knokke-Heist (BE)

(73) Assignee: UNIBIND LIMITED, Nicosia (CY)

( * ) Notice: Subject to any disclaimer, the term of this patent is extended or adjusted under 35 U.S.C. 154(b) by 0 days.

(21) Appl. No.: 15/578,276

(22) PCT Filed: Mar. 17, 2016

(86) PCT No.: PCT/IB2016/000319

§ 371 (c)(1),
(2) Date: Nov. 30, 2017

(87) PCT Pub. No.: WO2016/198930

PCT Pub. Date: Dec. 15, 2016

(65) Prior Publication Data

US 2018/0141367 A1 May 24, 2018

(30) Foreign Application Priority Data

Jun. 8, 2015 (BE) ..... 2015/5351
Sep. 18, 2015 (BE) ..... 2015/5581

(51) Int. Cl.

| | |
|---|---|
| ***B42D 3/00*** | (2006.01) |
| ***B42C 9/00*** | (2006.01) |
| ***B42D 3/02*** | (2006.01) |
| *B42F 7/00* | (2006.01) |

(52) U.S. Cl.

CPC ..... *B42C 9/0081* (2013.01); *B42C 9/00* (2013.01); *B42D 3/00* (2013.01); *B42D 3/002* (2013.01); *B42D 3/02* (2013.01); *B42F 7/00* (2013.01)

(58) Field of Classification Search

CPC ..... B42D 3/00; B42D 3/02; B42D 3/002
USPC ..... 281/29, 35, 36, 37; 412/4, 901
See application file for complete search history.

(56) References Cited

U.S. PATENT DOCUMENTS 3,749,422 A * 7/1973 Abildgaard ..... B42D 1/02 281/29
3,749,423 A * 7/1973 Abildgaard ..... B42D 1/02 412/901
3,912,304 A * 10/1975 Abildgaard ..... B42D 1/02 281/29

(Continued)

FOREIGN PATENT DOCUMENTS

BE 1015795 9/2005
CH 655 060 A5 3/1986

(Continued)

OTHER PUBLICATIONS

International Search Report, dated May 12, 2016, from corresponding PCT/IB2016/000319 application.

*Primary Examiner* — Kyle R Grabowski
(74) *Attorney, Agent, or Firm* — Young & Thompson

(57) ABSTRACT

Disclosed is a binding folder for binding a bundle of leaves, whereby this binding folder essentially includes a spine for enclosing an edge of the bundle of leaves and two cover sheets attached to the spine, at least one of which is made of a synthetic material. At least one cover sheet is provided with a top sheet against the side of the cover sheet oriented towards the inside of the binding folder, whereby this top sheet is attached to the cover sheet and/or spine in a removable way.

27 Claims, 7 Drawing Sheets

(56) References Cited

U.S. PATENT DOCUMENTS

Figure 1:
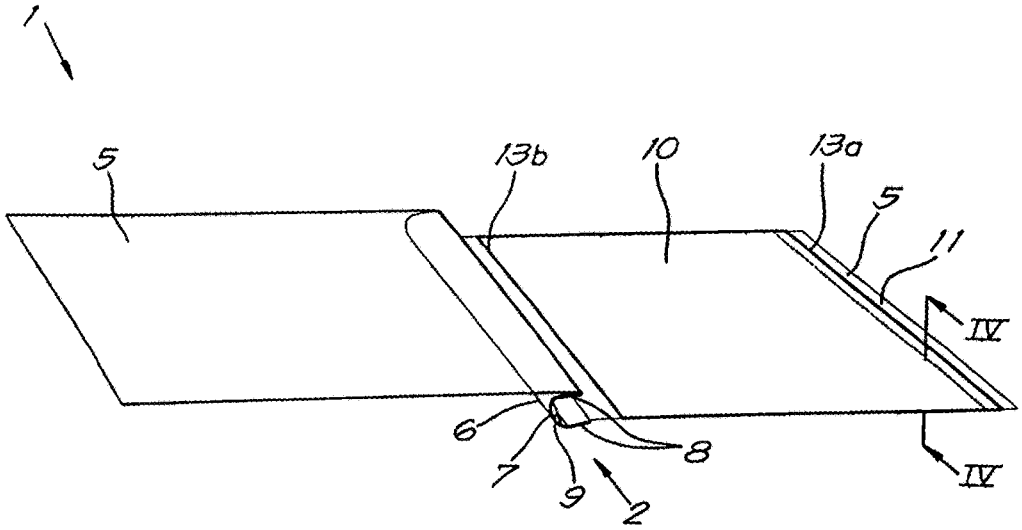

| | | | | |
|---|---|---|---|---|
| 5,314,283 | A | 5/1994 | Zoltner | |
| 6,039,494 | A | 3/2000 | Pearce | |
| 7,438,321 | B2 | 10/2008 | Peleman | |
| 7,648,172 | B2 * | 1/2010 | Steele | B42B 2/00 281/29 |
| 9,290,032 | B2 | 3/2016 | Peleman | |
| 10,160,250 | B2 | 12/2018 | Peleman | |
| 2004/0066030 | A1 * | 4/2004 | Parker | B42D 3/002 281/21.1 |
| 2004/0120793 | A1 | 6/2004 | Parker | |
| 2008/0073899 | A1 | 3/2008 | Parker et al. | |
| 2009/0263211 | A1 * | 10/2009 | Peleman | B42D 3/002 412/4 |
| 2010/0028671 | A1 * | 2/2010 | Mitsui | B32B 7/12 428/354 |
| 2014/0125047 | A1 * | 5/2014 | Thibierge | B42D 3/02 281/27.3 |

FOREIGN PATENT DOCUMENTS

| | | | | |
|---|---|---|---|---|
| CL | 2014000859 | | 11/2014 | |
| CL | 2015003387 | | 8/2016 | |
| CL | 55496 | | 2/2018 | |
| DE | 10 2004 045603 | A1 | 4/2006 | |
| GB | 1480954 | A * | 7/1977 | B42D 3/00 |

* cited by examiner

BINDING FOLDER

The present invention relates to a binding folder.

More specifically, the invention relates to a binding folder that is provided with a spine that is intended to have an edge of a bundle of leaves inserted therein, whereby this spine is provided with two cover sheets that are intended to protect the bundle of leaves.

Such binding folders are already known and enable a bound bundle of leaves or a book to be produced easily and flexibly.

The known binding folders comprise a metal or cardboard spine provided with hotmelt adhesive to which two, often plastic, cover sheets are attached.

Plastic cover sheets have the advantage that they are light and robust, and in most cases are resistant to moisture or water, such as rain for example.

The bundle of leaves can be affixed in the spine by means of the hotmelt adhesive, whereby it is possible that the arms of the spine are then bent towards one another to fit relatively closely against the bundle or even to clamp in the bundle.

Such known binding folders present the disadvantage that the plastic cover sheets are often statically charged, such that when inserting the bundle of leaves, the outermost leaves experience a type of force of attraction as a result of this static electricity that results in the leaf clinging to the plastic cover sheets as it were.

As a result the outermost leaves are not affixed or not well affixed in the spine.

Cover sheets with a smooth or shiny surface in particular are subject to these detrimental effects of static electricity or static charge.

This has the disadvantage that the outermost leaves are not well aligned with the rest of the bundle of leaves. The finished, bound bundle thus has an inferior quality and appearance or 'look'.

An additional disadvantage is that the outermost leaves are not well affixed in the hotmelt adhesive so that they are not bonded in the spine. This means that these leaves can come loose from the finished and bound bundle.

There are already solutions for such problems.

A first known solution consists of a device that can remove this charge from the surface of the cover sheets.

This is very expensive and very difficult to apply to a finished product.

Moreover, the slightest rubbing on the surface of the plastic cover sheet will charge this surface again. For example, sliding two binding folders over one another or taking a binding folder out of packaging will be sufficient to create static electricity again.

Another known solution consists of making the surface of the cover sheet rougher with micro-irregularities. This will ensure that air can always remain between the outermost leaf of the bundle and the cover sheet.

As a result of this air layer the force of attraction or the 'adhesive force' between the outermost leaf and the cover sheet is reduced, but not completely absent.

An additional disadvantage of this is that the appearance of the cover sheet is changed and that a previously shiny cover sheet becomes matt due to these irregularities and that, due to these irregularities, a previously transparent cover sheet is no longer transparent, which is desirable for most end users.

The purpose of the present invention is to provide a solution to at least one of the aforementioned and other disadvantages.

To this end the invention concerns a binding folder for binding a bundle of leaves, whereby this binding folder essentially comprises a spine for enclosing an edge of the bundle of leaves and two cover sheets attached to the spine, at least one of which is made of a synthetic material, whereby at least one cover sheet is provided with a top sheet against the side of the cover sheet oriented towards the inside of the binding folder, whereby this top sheet is attached to the cover sheet and/or spine in a removable way.

The side of the cover sheet oriented towards the inside of the binding folder means the side of the cover sheet that will be oriented towards the bundle of leaves when the bundle of leaves is bound by means of the binding folder.

An advantage is that the top sheet that is affixed against the plastic cover sheet will ensure that the outermost leaves of the bundle are not held back by the static charge of the cover sheet.

In order to obtain this effect the top sheet is made of a material that is not statically charged or scarcely statically charged, or very difficult to statically charge, such as single-layer or multilayer paper, cardboard, a synthetic material, or any material that is barely statically charged due to rubbing.

The top sheet will act as a type of intermediate screen between the strongly electrostatically charged or otherwise cover sheet and the outermost leaves of the bundle, so that they cannot 'cling' together.

Due to the intermediate screen or top sheet, the outermost leaf of the bundle together with the other leaves of the bundle can be affixed in the spine.

As a result all leaves of the bound bundle are nicely aligned so that a nice and perfectly bound bundle of leaves can be obtained.

Moreover, all leaves will be affixed well in the spine and in any hotmelt adhesive, so that a good binding of all leaves can be obtained.

Because the top sheet is attached in a removable way to the cover sheet and/or the spine, after binding the bundle it can be removed so that it is no longer visible in the finished and bound bundle, possibly save for a small remaining piece.

This is also a cheap and effective solution for the detrimental effects of the static charge.

Moreover, it will be possible to use transparent cover sheets with a smooth surface, i.e. without micro-irregularities.

It is possible that both cover sheets are made of a synthetic material, but it is also possible that one of the two cover sheets is made of another material, such as paper or cardboard for example.

Preferably the top sheet is attached to the binding folder by means of an adhesive that is provided on the top sheet.

This has the advantage that it is easy to realise, for example by bonding such a top sheet to the cover sheet with an adhesive after production of the binding folder.

According to a preferred characteristic of the invention the top sheet is approximately just as large as the cover sheet.

This has the advantage that the outermost leaves of the bundle will have optimum protection against the effects of any static charge on the cover sheet.

If both cover sheets are made of a synthetic material or another material that is sensitive to electrostatic charge, preferably each cover sheet is provided with a top sheet against the side of the cover sheet concerned oriented towards the inside of the binding folder, whereby this top sheet is attached in a removable way to the cover sheet concerned and/or the spine.

In this way the outermost leaves of both sides of the bundle are protected against the static charge on the plastic cover sheets.

Figure 2:
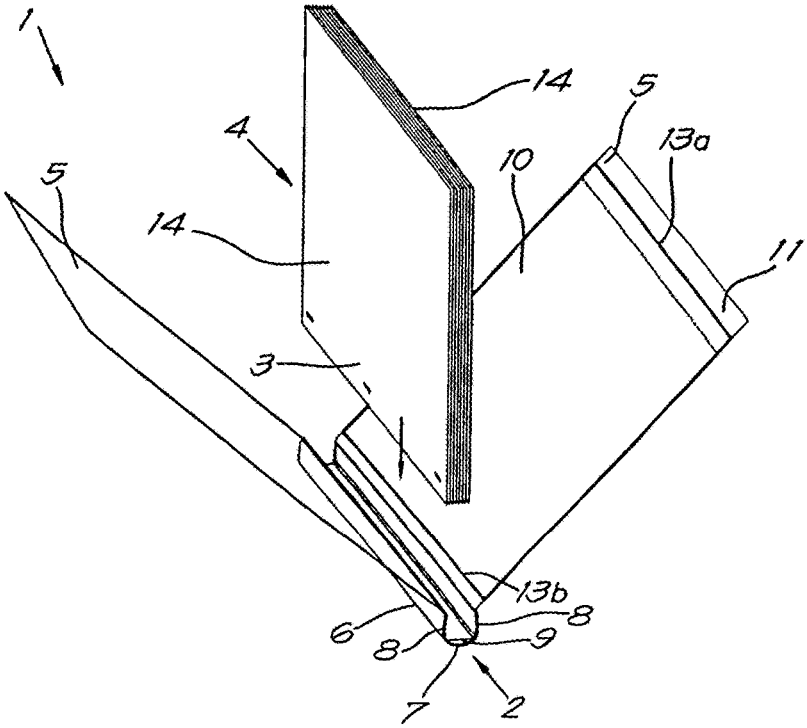
Figure 3:
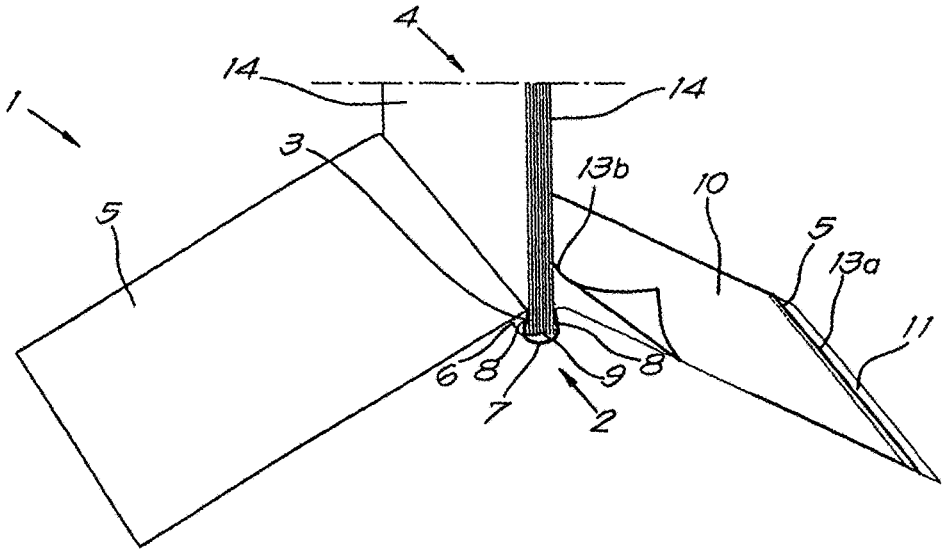
Figure 4:
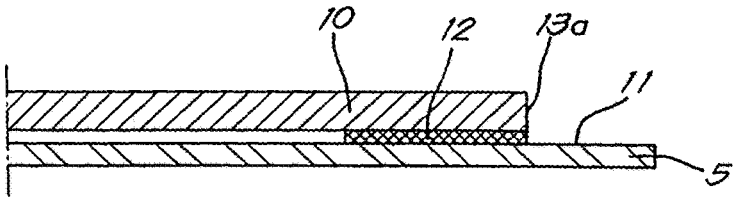
Figure 5:
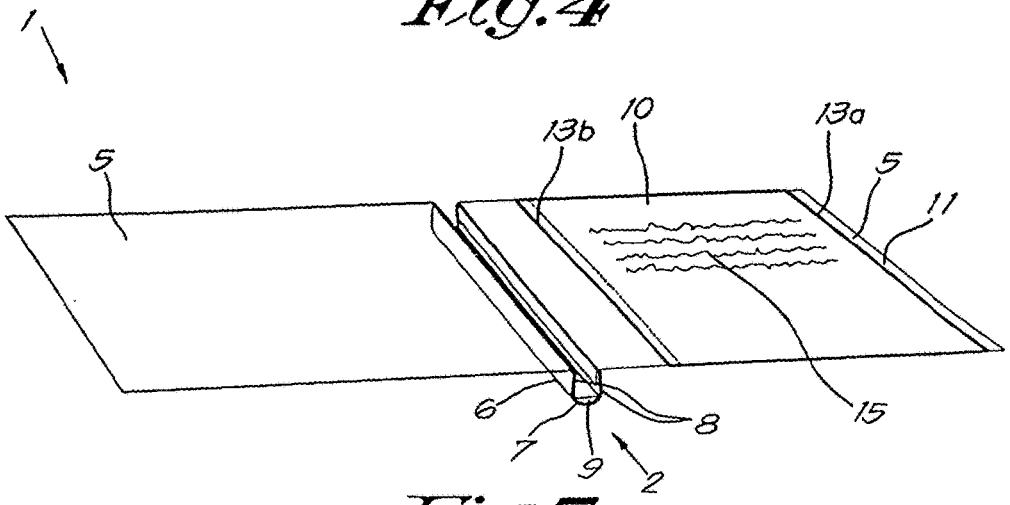
Figure 6:
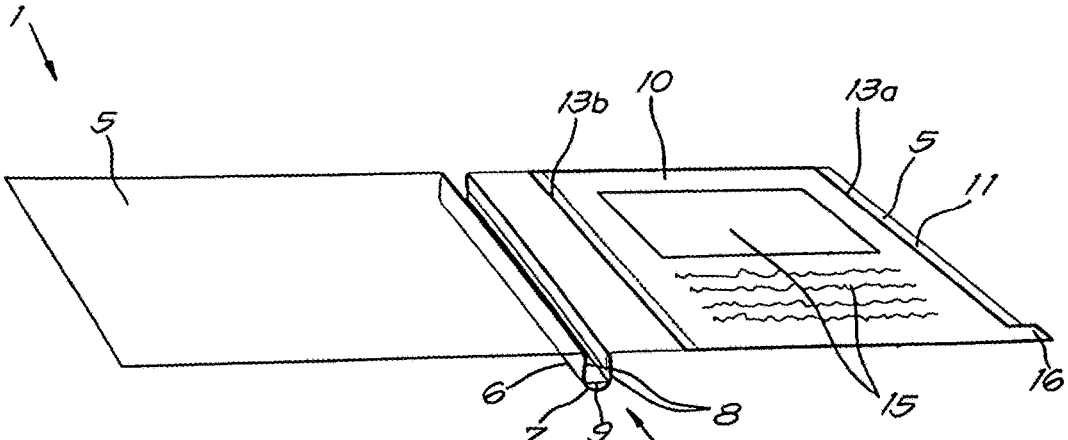
Figure 7:
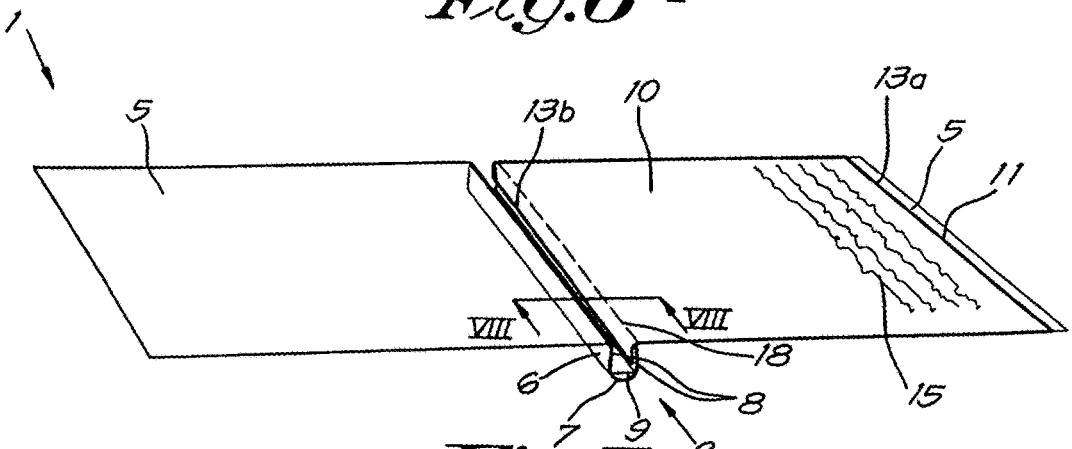
Figure 8:
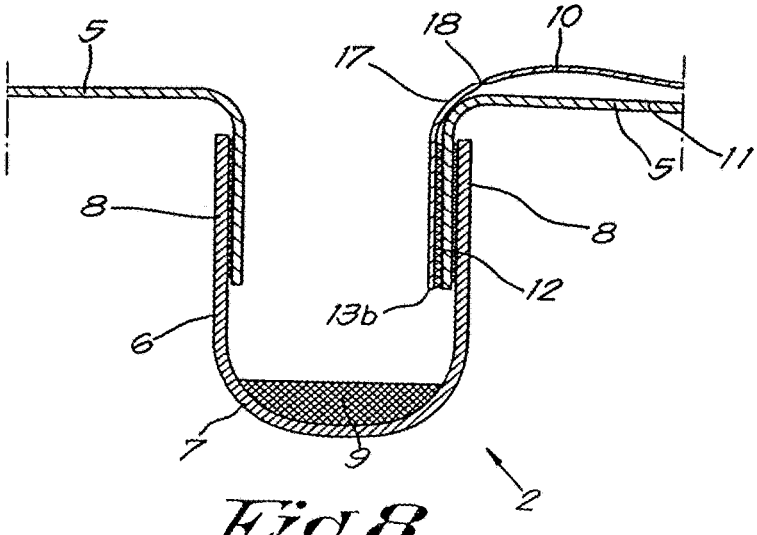
Figure 9:
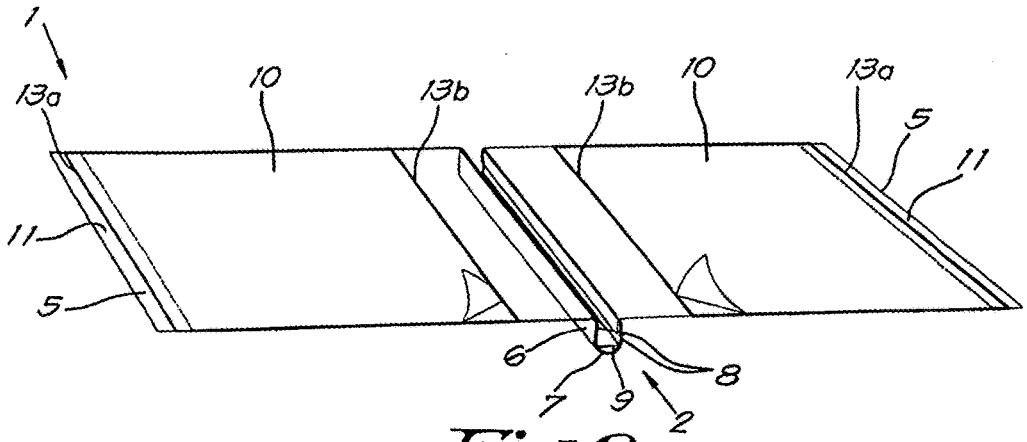
Figure 10:
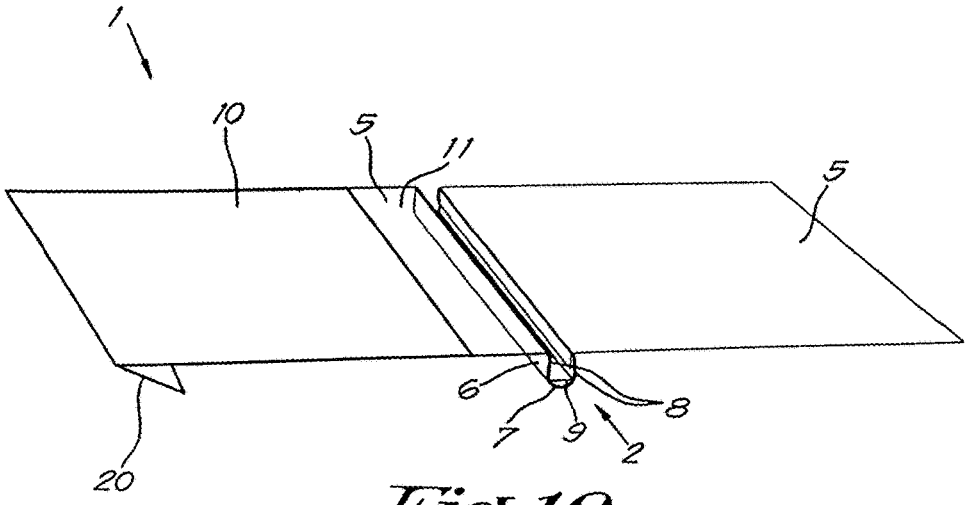
Figure 11:
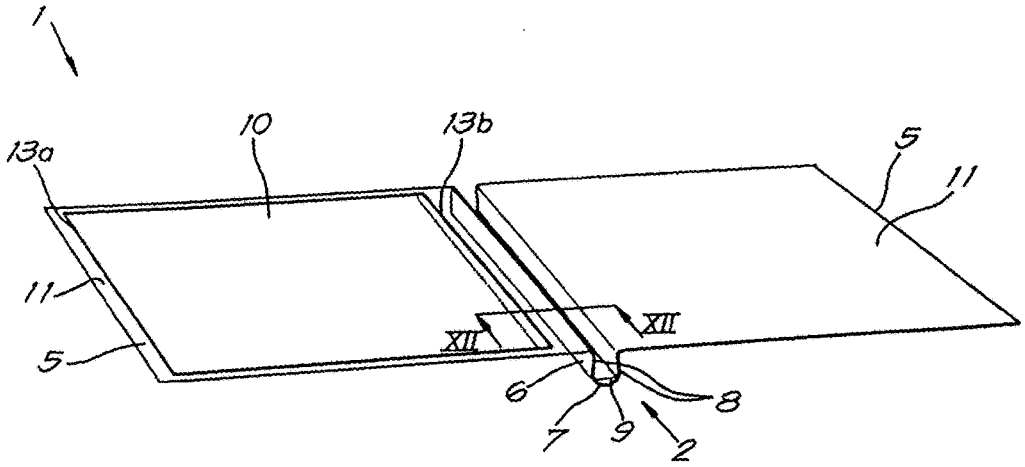
Figure 12:
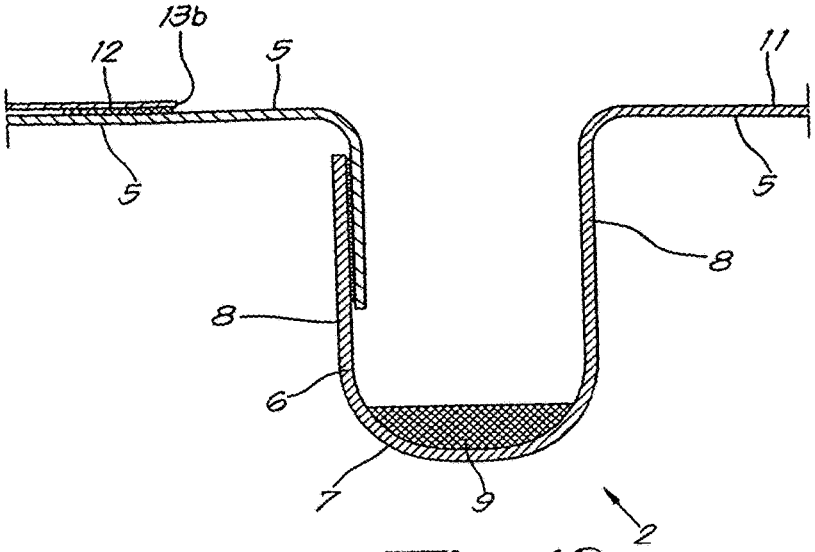
Figure 13:
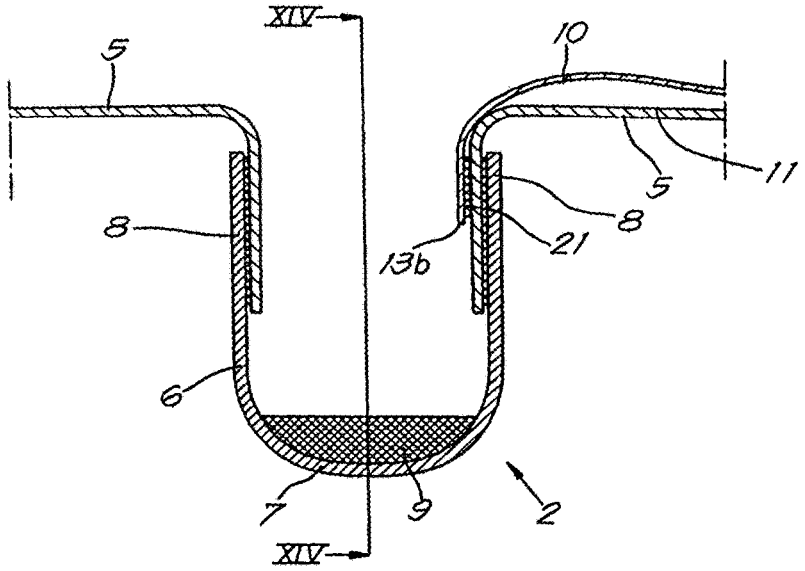
Figure 14:
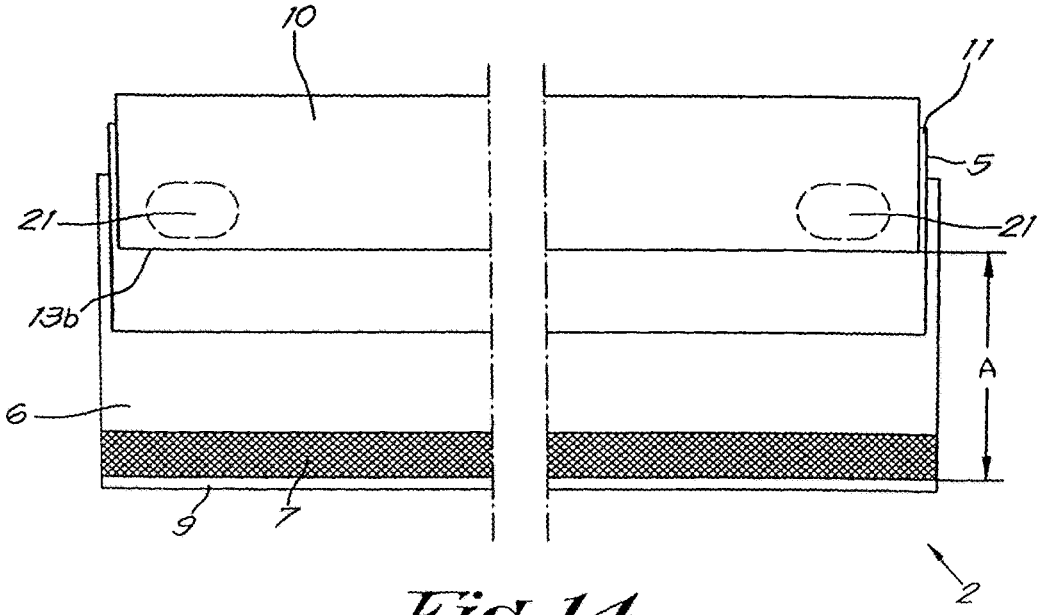
Figure 15:
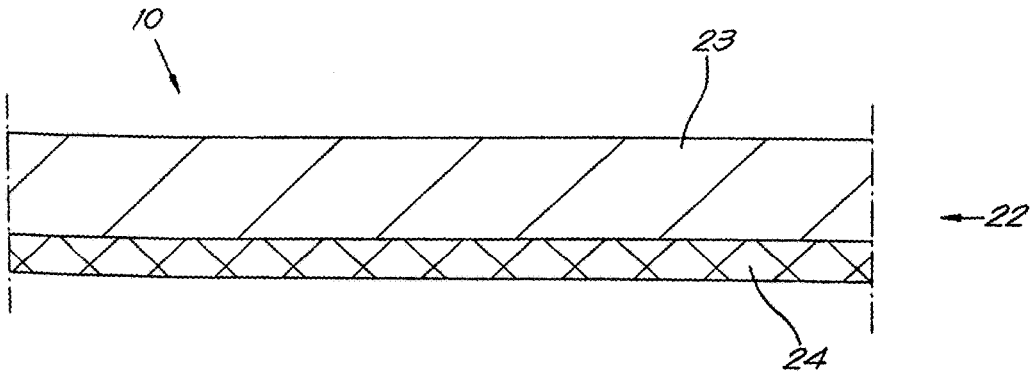

With the intention of better showing the characteristics of the invention, a few preferred embodiments of a binding folder according to the invention are described hereinafter by way of an example, without any limiting nature, with reference to the accompanying drawings, wherein:

FIG. 1 schematically shows a perspective view of a binding folder according to the invention;

FIGS. 2 and 3 schematically show a method for binding a bundle of leaves in the binding folder of FIG. 1;

FIG. 4 schematically shows a cross-section according to line IV-IV of FIG. 1;

FIG. 5 schematically shows another embodiment of a binding folder according to the invention;

FIG. 6 schematically shows another variant of a binding folder according to the invention;

FIGS. 7 and 8 schematically show another embodiment of a binding folder according to the invention;

FIGS. 9 and 10 show two other variants of a binding folder according to the invention;

FIGS. 11 and 12 schematically show another embodiment of a binding folder according to the invention;

FIGS. 13 and 14 schematically show another embodiment of a binding folder according to the invention;

FIG. 15 shows a top sheet in the form of a multilayer film.

The binding folder 1 according to the invention shown in FIGS. 1 to 4 essentially comprises a spine 2 for enclosing an edge 3 of a bundle of leaves 4 and two cover sheets 5 that are attached to the spine 2.

In this case, but not necessarily, the spine 2 is a U-shaped or V-shaped profile with a base 7 and two arms 8.

As shown in FIG. 1, in this example the spine 2 is provided with a layer of adhesive 9 on the inside for attaching the aforementioned edge 3 of the bundle of leaves 4.

This adhesive 9 is a hotmelt adhesive for example that will melt due to the heating of the base 7 of the spine 2.

According to the invention at least one cover sheet 5 or both cover sheets are made of a synthetic material. In this case both cover sheets 5 are made of a synthetic material and one cover sheet 5 is provided with a smooth and shiny surface. Such a type of cover sheet 5 is preferred by most end users because it has very good aesthetic properties. Moreover, a smooth cover sheet 5 can also be made transparent, in contrast to a rough cover sheet 5.

The other cover sheet 5 can be provided with a matt and translucent surface, and is translucent but not transparent.

According to the invention at least one cover sheet 5, in this case the smooth and shiny cover sheet 5, is provided with a top sheet 10, which in this case is made of paper or an antistatic synthetic material, in other words a synthetic material on which or in which no or practically no static electric charge can accumulate.

An example of an antistatic synthetic material is an antistatic polyethylene film (LDPE film) that moreover provides the advantage of being scratch-free, and consequently the cover sheet 5 on which the top sheet 10 is attached is protected against scratches.

Such an antistatic film can also be made transparent so that in the case of a transparent cover sheet 5 the transparency is preserved after affixing the cover sheet 10, so that it is immediately clear to the user when choosing a new binding folder 1 that he can select a binding folder 1 with transparent cover sheet 5 without first having to consult the packaging thereon.

The top sheet 10 is affixed against the side 11 of the cover sheet 5 oriented towards the inside of the binding folder 1, i.e. against the side 11 of the cover sheet 5 that will be oriented towards the bound bundle 4 of leaves. This side 11 can be considered as the 'inside' of the cover sheet 5.

In this case, the top sheet 10 is somewhat smaller than the dimensions of the cover sheet 5.

The cover sheet 10 is attached to the cover sheet 5 in a removable way.

In the example shown, by means of an adhesive that is provided in the form of a strip of adhesive 12 on the top sheet 10, as can be seen in FIG. 4.

In this case the strip of adhesive 12 is a continuous strip 12, but can also be a discontinuous strip 12 that is made up of a number of successive partial strips of adhesive, with zones in between that are free of adhesive.

The adhesive used for the strip 12 is preferably a glue or cold glue that can be self-adhesive or otherwise, and which will enable the top sheet 10 with the adhesive to be removed from the binding folder 1.

The strip of adhesive 12 is situated on an edge 13*a* of the top sheet 10, whereby this edge 13*a* extends parallel to the spine 2. This is schematically shown in FIG. 4.

As can be seen, this edge 13*a* of the top sheet 10, where the strip of adhesive 12 is located, is oriented away from the spine 2.

The other edge 13*b* of the top sheet 10 that extends parallel to the spine 2 and is located closer to the spine 2, is not provided with a strip of adhesive and can in principle be lifted up. But, due to the possible presence of static electricity the top sheet 10 will 'cling' to the cover sheet 5 due to the force of attraction of the static charge or by adhesion or the vacuum between the cover sheet 5 and the top sheet 10.

It is clear that although the strip of adhesive 12 is parallel to the spine 2, it can also be affixed obliquely opposite the spine 2. This means that the strip of adhesive 12 does not extend parallel to the spine 2.

The strip of adhesive 12 can be affixed at the location of the edge 13*a* or 13*b*, or at any position between these two edges 13*a* or 13*b* or over the entire surface between 13*a* and 13*b*.

In order to bind a bundle of leaves 4 in a binding folder 1, as shown in FIGS. 1 to 4, one can proceed as follows.

A bundle of leaves 4 is affixed in the spine 2 of the binding folder 1, for example by holding the spine 2 with one hand and introducing the bundle of leaves 4 into the spine 2 with the other hand until the aforementioned edge 3 is against the base 7 covered with a layer of adhesive 9. This is shown in FIG. 2.

Because of the top sheet 10 there will be no force of attraction between the outermost leaves 14 of the bundle 4 and the cover sheets 5 so that all leaves of the bundle 14 will go into the hotmelt adhesive 9.

Because the strip of adhesive 12 is at the edge 13*a* of the top sheet 10 that is oriented away from the spine 2 or over the entire surface of the cover sheet 10, the outermost leaves 14 of the bundle 4 will not undesirably and accidentally end up between the top sheet 10 and the cover sheet 5, because the strip of adhesive 12 will keep the top sheet 10 against the cover sheet 5.

Then the layer of hotmelt adhesive 9 in the spine 2 will be heated so that it becomes liquid.

This can be done by placing the binding folder 1 with the spine 2 on a hot plate, so that the layer of hotmelt adhesive 9 will melt under the influence of the heat.

After solidification of the hotmelt adhesive 9 in the spine 2, the bundle of leaves 4 will be bound in the binding folder 1.

If desired, the arms 8 of the spine 2 can also be folded or pressed in to clamp the bundle 4 between the arms 8 of the spine 2.

Then the top sheet 10 can be removed by lifting up the aforementioned edge 13*b* of the top sheet 10 that is not provided with a strip of adhesive 12 and thereby detaching the strip of adhesive 12 from the cover sheet 5.

Because use is made of a self-adhesive glue, this top sheet 10 can easily be removed without leaving adhesive residues on the cover sheet 5.

The user can of course choose not to remove the top sheet so that when leafing through the folder with a bound bundle 4, the outermost leaves 14 of the bundle do not continue to cling to the cover sheets 5.

FIG. 5 shows a variant of FIG. 1. In this case the strip of adhesive 12 is on the edge 13*b* of the top sheet 10 that extends parallel to the spine 2 and is located close to the spine 2 of the binding folder 1.

Furthermore the top sheet 10 is provided with printing 15 on one side. It is not excluded that the other side or both sides of the top sheet 10 are provided with printing 15.

This printing 15 can comprise instructions for example on the use of the binding folder 1 or other information, or promotional or advertising messages, for example.

An advantage of the top sheet 10 that comprises instructions is that this information will not be lost because the top sheet 10 is affixed in the binding folder 1.

The user will always have this 'memory aid' available for each binding folder that he uses to bind a bundle of leaves 4, so that a nicely bound bundle 4 can be obtained each time by following the instructions.

FIG. 6 shows a variant of FIG. 5 whereby the top sheet 10 protrudes past the periphery of the cover sheet 5 by at least a section 16.

In this case the top sheet 10 is provided with a 'tab' or protruding lip 16.

This has the advantage that the top sheet 10 can be easily removed, even if it is attracted to the cover sheet 5 by the static charge of the cover sheet 5, by taking hold of this protruding section 16.

FIGS. 7 and 8 show another embodiment, whereby in this case the adhesive of the top sheet 10 is provided with a tear-off strip 17 of the top sheet 10. The tear-off strip is separated from the top sheet 10 by means of a perforated line 18 (or tear line).

The top sheet 10 is affixed against the cover sheet 5 such that the tear-off strip 17 is at least partially in the spine 2, as can be clearly seen in FIG. 8.

In other words the strip of adhesive 12 is against an arm 8 of the spine 2. In other words, the top sheet 10 is attached to the spine 2 of the binding folder 1 and not to a cover sheet 5, such as in the previous embodiments.

It is of course not excluded that the tear-off strip 17 is completely in the spine 1.

Preferably the width of the tear-off strip 17 is equal or approximately equal to the depth of the spine 2. This has the advantage that the strip 17 is completely in the spine 2, but that the protective strip 10 can still easily be torn away along the perforated line 18 because it is situated at the location of the free end of the arms 8.

After affixing a bundle of leaves 4 in the binding folder 1 as shown in FIGS. 7 and 8, the top sheet 10 can be released along the perforated line 18 and removed, whereby the tear-off strip 17 will remain behind in the binding folder 1.

As the strip 17 is as good as completely in the spine 2, it will almost be invisible.

Although in the example of FIGS. 7 and 8 the adhesive is provided in the form of a strip of adhesive 12, it is not excluded that the adhesive is provided in the form of one, two, three or more drops of adhesive.

FIG. 9 shows another alternative embodiment of FIG. 1, whereby in this case both cover sheets 5 are provided with a top sheet 10 against the side 11 of each cover sheet 5 oriented towards the inside of the binding folder 1.

The strips of adhesive 12 are both on an edge 13*a* of the cover sheet 10 oriented away from the spine.

Although in the examples shown above the adhesive is applied in the form of a continuous, uninterrupted strip of adhesive 12 on the top sheet 10, it is not excluded that the adhesive is applied over the entire surface of the top sheet 10 or in the form of a number of local points. For example, the adhesive can be applied on the surface of the top sheet 10 in the form of one, two, three or more drops of adhesive or in the form of a discontinuous strip of adhesive that is made up of a number of consecutive partial strips of adhesive with zones in between that are free of adhesive. It is also not excluded that a number of continuous or discontinuous strips of adhesive 12 are applied.

It is also possible that the adhesive 12 is applied in a thin layer over an entire side of the top sheet 10. In this case, for example, for the cover sheet 10 use can be made of a multilayer film 22 cut to size with an antistatic outer layer 23, for example antistatic polyethylene, and a thin layer of adhesive 24 as shown in FIG. 15.

As described above the strip of adhesive 12 can be applied in parallel or otherwise to the spine 2 at each location between the edge 13*a* and the edge 13*b* of the top sheet 10.

FIG. 10 shows another embodiment, whereby in this case the top sheet 10 is not attached to the cover sheet 5 by means of an adhesive, but whereby the top sheet 10 comprises a folded strip 19 with which it is affixed around a free edge 20 of the cover sheet 5.

In the drawing shown this free edge 20 is parallel to the spine, but this is not necessarily the case.

Hereby the folded strip 19 is preferably affixed on the outside of the cover sheet 5, as can be seen in FIG. 10.

Such an embodiment has the advantage that no adhesive is required. The top sheet 10 is attracted to the cover sheet 5 due to the static charge of the cover sheet 5, so that it remains in place.

The spine 2 of the binding folder 1 can be made of metal that is clad with paper or fabric or otherwise, but can also be made of cardboard or a synthetic material.

FIGS. 11 and 12 show such an embodiment whereby the binding folder 1 is provided with a spine 2 of cardboard, whereby a cover sheet 5 is also made of cardboard.

In this case, but not necessarily, this first cover sheet 5 and the spine 2 are made of one continuous piece of cardboard. This can clearly be seen in FIG. 12.

The second cover sheet 5 is made of a synthetic material. This can be a matt or smooth and shiny synthetic material, transparent or otherwise.

This second cover sheet 5 is provided with a top sheet 10, analogous to FIG. 5 for example.

FIGS. 13 and 14 show a last embodiment of a binding folder 1 according to the invention.

The binding folder 1 is provided with a top sheet 10 that is affixed to one of the cover sheets 5.

In this case adhesive is provided on the top sheet 10 in the form of two drops of adhesive 21, on an edge 13*b* of the top sheet 10 that extends parallel to the spine 2, whereby this edge 13*b* is oriented towards the spine 2.

The drops of adhesive 21 are situated at the location of the corners of the top sheet 10, but this is not necessarily the case.

Moreover, there can only be one drop or three or more drops of adhesive 21.

The drops of adhesive 21 ensure an attachment of the cover sheet 10 at a number of local points.

In this case the top sheet 10 is affixed against the cover sheet 5 such that the aforementioned drops of adhesive 21 are at the location of the spine 2, more specifically at an upright arm 8 of the spine 2.

The aforementioned edge 13 is at some distance A from the base 7 of the spine 2.

This distance A is preferably between three and seven millimeters or even better between five and seven millimeters.

As a result this can prevent the top sheet 10 from also being bound in the spine 2 by means of the hotmelt adhesive 9, when a bundle 4 is bound in the spine 2.

The difference to the embodiment of FIGS. 7 and 8 is that there is no tear-off strip 17 and perforated line 18.

In this case the cover sheet 10 will be completely removed after the bundle 4 is affixed in the binding folder 1. Because only two drops of adhesive 21 are used, it will be possible to completely remove the top sheet 10 from the binding folder 1.

An advantage is that the tear-off strip 17 is not left behind in the spine 2, which can be unattractive if the tearing is not done neatly.

Moreover, this has the advantage that if adhesive is left behind on the cover sheet 5, it will not be visible because the adhesive left behind will be at a location that is hidden from view after binding a bundle 4.

Although in the example of FIGS. 13 and 14 the adhesive is applied in the form of drops of adhesive 21, it is not excluded that the adhesive is applied in the form of a continuous uninterrupted strip of adhesive 12. Hereby this strip of adhesive 12 is preferably made as thin as possible, so that it remains possible to remove the top sheet 10 from the spine 2. Alternatively, the adhesive can be applied in the form of a discontinuous strip of adhesive 12, whereby the strip is made up of various partial strips of adhesive with zones or spaces between them that are free of adhesive.

It is also possible to apply the strip of adhesive 12 in the centre over a length of 10 cm for example in discontinuous or continuous form.

The present invention is by no means limited to the embodiments described as an example and shown in the drawings, but a binding folder according to the invention can be realised in all kinds of forms and dimensions, without departing from the scope of the invention.

The invention claimed is:

1. A binding folder for binding a bundle of leaves (4), the binding folder (1) essentially comprising:

a spine (2) for enclosing an edge (3) of the bundle of leaves (4);

two cover sheets (5) attached to the spine, wherein at least a first one of the two cover sheets is made of a synthetic material; and a top sheet (10) provided against a side (11) of at least one of the two cover sheets (5), the side (11) of the at least one of the cover sheets (5) being provided with the top sheet (10) being oriented towards an inside of the binding folder (1), wherein the top sheet is provided with an adhesive, wherein the top sheet (10) is attached, by the adhesive, to the side (11) of the at least one of the two cover sheets (5) in a removable way, whereby lifting of the top sheet detaches the adhesive and the top sheet from the side (11) of the at least one of the two cover sheets (5).

2. The binding folder according to claim 1, wherein the top sheet (10) is made of paper, cardboard or any other material with antistatic properties.

3. The binding folder according to claim 1, wherein the top sheet (10) is made of a single-layer or multilayer synthetic material of which at least one outer layer is antistatic and the other outer layer has a layer of the adhesive.

4. The binding folder according to claim 3, wherein the top sheet (10) or at least an outer layer thereof is made of an antistatic polyethylene film.

5. The binding folder according to claim 4, wherein the top sheet (10) is made of an antistatic polyethylene film that is transparent and which is provided with a layer of the adhesive on one side.

6. The binding folder according to claim 1, wherein the adhesive is provided in the form of a strip of adhesive (12) on an edge (13*a*, 13*b*) of the top sheet (10), whereby the edge (13*a*, 13*b*) of the top sheet (10) extends parallel to the spine (2) and is oriented away and remote from the spine (2), and wherein an edge (13*a*) of the top sheet (10) with the adhesive is oriented closest to the spine (2) is adhesive-free.

7. The binding folder according to claim 1, wherein the adhesive is provided in the form of a strip of adhesive (12) or in the form of one, two, three or more drops of adhesive (21) on an edge (13*a*, 13*b*) of the top sheet (10), whereby the edge (13*a*, 13*b*) of the top sheet (10) extends parallel to the spine (2).

8. The binding folder according to claim 7, wherein the edge (13*a*) of the top sheet (10) is oriented away from the spine (2).

9. The binding folder according to claim 7, wherein the edge (13*b*) of the top sheet (10) is oriented towards the spine (2).

10. The binding folder according to claim 9, wherein the top sheet (10) is affixed against the cover sheet (5) such that the strip of adhesive (12), or the one, two, three or more drops of adhesive (21), is at a location of the spine (2) at an upright arm (8) of the spine (2).

11. The binding folder according to claim 10, wherein the edge (13*b*) of the top sheet (10) is at some distance (A) from a base (7) of the spine (2).

12. The binding folder according to claim 11, wherein the distance (A) is between five and seven millimeters.

13. The binding folder according to claim 1, wherein the adhesive is provided on a tear-off strip (17) of the top sheet (10), whereby the top sheet (10) is affixed against the cover sheet (5) such that the tear-off strip (17) is at least partially in the spine (2).

14. The binding folder according to claim 13, wherein the adhesive is provided in the form of a strip of adhesive (12) or in the form of one, two, three or more drops of adhesive (21).

15. The binding folder according to claim 13, wherein the width of the tear-off strip (17) is equal to a depth of the spine (2).

16. The binding folder according to claim 1, wherein the top sheet (10) comprises a folded strip (19), the top sheet being attached to the cover sheet (5) by the folded strip (19) being affixed around a free edge (20) of the cover sheet (5).

17. The binding folder according to claim 1, wherein the cover sheet (5) has a smooth and/or shiny surface.

18. The binding folder according to claim 1, wherein the top sheet (10) is approximately just as large as the cover sheet (5).

19. The binding folder according to claim 1, wherein the top sheet (10) protrudes by at least a section (16) past a periphery of the cover sheet (5).

20. The binding folder according to claim 19, wherein the spine (2) is provided with a layer of adhesive (9) on the inside for attaching the edge (3) of the bundle of leaves (4) to the spine (2).

21. The binding folder according to claim 1, wherein the top sheet (10) is provided with printing (15) on at least one side.

22. The binding folder according to claim 1, wherein each cover sheet (5) is provided with a top sheet (10) against the side (11) of the cover sheet (5) concerned oriented towards the inside of the binding folder, whereby each top sheet (10) is attached in a removable way to the cover sheet (5) concerned and/or the spine (2).

23. The binding folder according to claim 1, wherein the spine (2) is a U-shaped or V-shaped profile (6) of paper, cardboard, metal or a synthetic material with a base (7) and two symmetrical or asymmetrical arms (8).

24. The binding folder according to claim 1, wherein both of the two cover sheets (5) are made of a synthetic material.

25. The binding folder according to claim 1, wherein the top sheet is an antistatic plastic film.

26. The binding folder according to claim 25, wherein the antistatic plastic film is a multilayer film (22) with an outer layer (23) of antistatic polyethylene and a layer of the adhesive (24).

27. The binding folder according to claim 1, wherein, one edge of the top sheet is not provided with the adhesive, and the lifting of the top sheet at the one edge of the top sheet is not provided with the adhesive, detaches the adhesive and the top sheet from the side (11) of the at least one of the two cover sheets (5) leaving the side (11) of the at least one of the two cover sheets (5) free of adhesive residues.

* * * * *